US009042805B2

(12) United States Patent
Kawachi et al.

(10) Patent No.: US 9,042,805 B2
(45) Date of Patent: May 26, 2015

(54) IMAGE FORMING APPARATUS

(75) Inventors: Kunihiro Kawachi, Kokubunji (JP); Tarou Miyamoto, Toyokawa (JP); Kyoichi Mizuno, Tama (JP); Yusuke Kawanago, Hachioji (JP)

(73) Assignee: KONICA MINOLTA, INC. (JP)

( * ) Notice: Subject to any disclaimer, the term of this patent is extended or adjusted under 35 U.S.C. 154(b) by 300 days.

(21) Appl. No.: 13/217,355

(22) Filed: Aug. 25, 2011

(65) Prior Publication Data

US 2012/0057913 A1 Mar. 8, 2012

(30) Foreign Application Priority Data

Sep. 2, 2010 (JP) ..... 2010-196453
Sep. 2, 2010 (JP) ..... 2010-196454

(51) Int. Cl.
*G03G 15/00* (2006.01)
*B65H 9/00* (2006.01)
*G03G 15/23* (2006.01)

(52) U.S. Cl.
CPC ..... *B65H 9/006* (2013.01); *B65H 2511/33* (2013.01); *B65H 2513/40* (2013.01); *B65H 2801/06* (2013.01); *G03G 15/6567* (2013.01); *G03G 15/235* (2013.01)

(58) Field of Classification Search
CPC ..... B65H 2801/06; B65H 2513/40; G03G 15/235; G03G 15/6561; G03G 2215/00405
USPC ..... 399/394, 395
See application file for complete search history.

(56) References Cited

U.S. PATENT DOCUMENTS

| | | | | |
|---|---|---|---|---|
| 5,612,776 | A * | 3/1997 | Machino et al. | 399/43 |
| 6,385,406 | B1 * | 5/2002 | Funamizu et al. | 399/16 |
| 6,866,260 | B2 * | 3/2005 | Williams et al. | 271/227 |
| 7,300,054 | B2 | 11/2007 | Suga et al. | |
| 2003/0043250 | A1 * | 3/2003 | Askren et al. | 347/106 |
| 2003/0085505 | A1 | 5/2003 | Inoue et al. | |

FOREIGN PATENT DOCUMENTS

| | | | |
|---|---|---|---|
| CN | 1576209 | A | 2/2005 |
| JP | 2008-265974 | A | 11/2008 |

OTHER PUBLICATIONS

Chinese Office Action for Application No. 201110252355.6, Mailing Date Nov. 19, 2013, with English Translation.

* cited by examiner

*Primary Examiner* — Matthew G Marini
(74) *Attorney, Agent, or Firm* — Cantor Colburn LLP

(57) ABSTRACT

A control section controls the rotation of a registration roller that corrects the skew of a sheet and conveys the sheet, and the rotation of a loop forming roller which forms a loop of the sheet, as well as the nipping and releasing of the nip of the loop forming roller. This control section controls so that the sheet with a loop formed between the registration roller and loop forming roller is conveyed downstream in the sheet conveyance direction, and the sheet is released from the nipping of the loop forming roller during the conveyance. This control section further controls so that the total number of rotations of the registration roller from the start of sheet conveyance till releasing of the sheet from nipping of the loop forming roller is kept at a prescribed total number of rotations preset in conformance to the paper type.

9 Claims, 7 Drawing Sheets

IMAGE FORMING APPARATUS

This application is based on Japanese Patent Application Nos. 2010-196453 and 2010-196454 filed on Sep. 2, 2010 with Japanese Patent Office, the entire content of which is hereby incorporated by reference.

BACKGROUND OF THE INVENTION

The present invention relates to an image forming apparatus provided with the functions of a photocopier, printer, facsimile and multi-functions thereof.

One of the techniques known in the conventional art is an image forming apparatus where a toner image is formed on the photoreceptor drum as an image carrier using electrophotographic process and the toner image is transferred onto a sheet of paper, and then the image is fixed by a fixing section.

In this image forming apparatus, when an image forming operation has started, the sheets stored in a sheet accommodation section are sequentially fed to a sheet conveyance path by a sheet feeding unit.

This sheet conveyance path is provided with a registration roller for nipping and conveying sheets and a loop forming roller arranged on the upstream side of this registration roller to nip and convey the sheets.

Each of the aforementioned registration roller and loop forming roller is made up of a pair of rollers composed of a drive roller and a driven roller.

The sheet fed out from a sheet feed section by the sheet feeding unit is conveyed by plural conveyance rollers including the loop forming roller arranged on the upstream side of the registration roller. The leading edge of the sheet is made to hit against the registration roller whose rotation has been suspended. After that, a loop is formed on the sheet by the rotation of the loop forming roller. This allows all area of the leading edge of the sheet to hit against the registration roller, whereby sheet skew is corrected.

After this correction of sheet skew, the registration roller starts to rotate synchronously with formation of an image on the photoreceptor drum, and the sheet is fed again. In this sheet re-feed operation, the sheet is conveyed while the sheet is kept looped by the rotating loop forming roller and is nipped by the registration roller.

In the aforementioned sheet re-feed process, width-wise bias of the sheet is corrected.

With respect to the aforementioned skew correction and bias correction, a proposal has been made of a sheet conveyance apparatus (see, e.g., Japanese Unexamined Patent Application Publication No. 2008-265974). According to this proposal, the leading edge of the sheet being conveyed is made to hit against the registration roller, and then the sheet is fed out to the next process downstream from the conveyance path, with the start of rotation of the registration roller. A guide member having a loop shape and arranged to extend in the direction perpendicular to the sheet conveyance direction is rotatably provided close to the upstream side of the registration roller.

In the Japanese Unexamined Patent Application Publication No. 2008-265974, the leading edge of the sheet having been conveyed by the conveyance rollers including the loop forming roller arranged upstream of the registration roller is made to hit against the registration roller whose rotation has been suspended. Further, a loop is formed on the sheet by the rotation of the loop forming roller, whereby skew of the sheet is corrected.

After the sheet skew correction, synchronously with image formation on the photoreceptor drum, the registration roller and loop forming roller are rotated at approximately the same speeds and the sheet is re-fed with the loop kept formed.

In the aforementioned sheet re-feeding step, bias of the sheet is corrected by width-wise traveling of the registration roller. In the aforementioned step of registration roller traveling, the aforementioned guide member is rotated in such a direction as to encourage displacement of the sheet that is displaced as a result of traveling of the registration roller, whereby distortion of sheets is minimized.

When the leading edge of the skewed sheet has been hit against the registration roller to correct skew, a difference occurs in the size of the loop on both ends across the width perpendicular to the sheet conveyance direction. To be more specific, there is a difference in the shape of the loop. The difference in the shape of the loop is greater as the skew is increased.

In the following description, the loop having a different shape is also called the uneven loop.

FIGS. 2*a* and 2*b* are schematic diagrams illustrating the sheet skew and skew correction. FIG. 2*a* shows that the sheet P is skewed and is conveyed by the loop forming roller 22D. FIG. 2*b* shows that, after the leading edge of the sheet P has been hit against the registration roller 23 whose rotation is suspended, a loop is formed on the sheet by the rotation of the loop forming roller 22D, and the sheet skew is corrected.

As shown in FIG. 2*b*, when the sheet P is skewed and the leading edge of the sheet P is made to hit against the registration roller 23, and then a loop is formed to correct skew, the loop will have different sizes in the cross-wise direction perpendicular to the sheet conveyance direction, i.e., on the downside of the FIG. 2*b* (also referred to as "on the near side" in the following description) and on the upside of the FIG. 2*b* (also referred to as "on the far side" in the following description). FIG. 2*b* shows an example wherein the loop L1 on the near side is greater than the loop L2 on the far side.

After the leading edge of the sheet has been hit against the registration roller, and skew has been corrected, the registration roller starts rotation. Then the sheet is flipped out by the bias force in the sheet conveyance direction, which is generated by the loop due to the toughness of the sheet P, and the sheet is nipped by the registration roller. The sheet is further fed out downstream while the loop is maintained by the rotating loop forming roller.

The aforementioned bias force differs according to the shape of a loop. The bias force is greater as the loop is smaller. Thus, the difference in the bias force is increased as the shape (size) of the loop is increased.

Accordingly, when the rotation of the registration roller has started and the sheet is fed by the registration roller and loop forming roller, the amount of conveyance on the smaller loop side (FIG. 2*b*, loop L2) is greater than that on the greater loop side (FIG. 2*b*, loop L1) under the influence of the difference in the bias force of the uneven loop. Thus, the sheet is conveyed with the leading edge kept in the shape of a fan.

FIG. 3 is a schematic diagram illustrating that a sheet is conveyed with the leading edge kept in a fan shape. A difference of distance d1 occurs on the right and left of the leading edge of the sheet P, and the fan shape shown by oblique lines (hatching) is created.

If the sheet is conveyed with such a fan shape, the positional accuracy of images on the front and rear surfaces will especially be deteriorated, in the case of duplex printing where the front surface is first printed and then the sheet P is reversed to perform printing on the rear surface.

FIG. 4 is a drawing showing the positions of images when a fan shape such as one shown in FIG. 3 has been produced on both surfaces in the duplex printing mode. In the drawing, the solid line indicates the front surface image position, and the broken line shows the rear surface image position.

As described above, in the Japanese Unexamined Patent Application Publication No. 2008-265974, a rotatable guide member is used to correct skew and bias of the sheet, whereby distortion of the sheet is suppressed. However, action is not taken to remove a difference in the amount of conveyance due to a difference in loop shape, i.e., to suppress formation of the fan shape. This method cannot easily improve the positional accuracy in printing, in particular, that in the duplex printing.

To minimize such image misalignment, it is preferred to release the sheet from the nipping of the loop forming roller 22D as quickly as possible so that the sheet can be conveyed only by the registration roller 23, without being adversely affected by the uneven loop.

The position of the leading edge with respect to the registration roller is different in conformity to the type of a sheet. The aforementioned type of the sheet denotes the differences in paper thickness, and differences in whether or not a toner image has been formed on the first surface of the sheet.

(1) In skew correction, when the leading edge of the sheet has been hit against the registration roller, the position of the leading edge with respect to the registration roller is different due to the difference in paper thickness.

FIG. 5 is a diagram illustrating the contrast in the respective positions of the leading edges when the leading edges of the thin sheet and thick sheet have been hit against the registration roller 23. It should be noted that FIG. 5 does not represent the actual diameter of the registration roller or actual thicknesses of the thin sheet and thick sheet and the values in FIG. 5 are exaggerated. In the drawing, a solid line indicates the leading edge of a thin sheet, while the broken line shows the leading edge of a thick sheet.

As shown in FIG. 5, when the leading edge of the sheet has been hit against the registration roller 23, the leading edge of the thin sheet comes closer to the nip section N formed by the drive roller 23*a* and driven roller 23*b*, than that of the thick paper. This produces a difference in distance d21.

Thus, after the rotation of the registration roller 23 has started, the sheet is conveyed downstream with the loop kept formed, and if the sheet is released from the nipping of the loop forming roller 22D after the lapse of a constant time, independently of the thickness of paper, the amount of conveyance before this release from the nipping is greater in the case of a thin sheet than that in the case of a thick sheet. To be more specific, the distance from the center of the registration roller nip to the leading edge of the sheet is greater in the case of a thin sheet than that in the case of a thick sheet. Thus, the fan-shaped portion is increased in size when a thin sheet is conveyed. To put it another way, the influence of the uneven loop is increased.

To avoid this, if a step is taken to reduce the time before the sheet is released from the nipping of the loop forming roller 22D, the amount of conveyance will be insufficient when the thick sheet is conveyed, and nipping at the registration roller 23 will be insufficient. Thus, failure of secure conveyance may be caused by nipping failure.

(2) In skew correction, when the leading edge of the sheet has been hit against the registration roller, the position of the leading edge with respect to the registration roller differs according to whether or not a toner image is formed on the first surface of the sheet.

As described above, each of the registration roller 23 and loop forming roller 22D is composed of a pair of rollers consisting of a drive roller and driven roller. The drive roller is placed at the position in contact with the surface opposite to the surface where an image is formed, while the driven roller is located at the position in contact with the surface where an image is formed.

In the following description, the term "opposite surface" indicates the surface of the sheet in contact with the drive roller, unless otherwise specified.

FIG. 6 is a diagram showing the positional relationship between the drive roller 23*a* and the driven roller 23*b* of the registration roller 23.

In the duplex printing mode where images are formed on both sides of a sheet, after an image has been formed on the first surface of the sheet, the sheet is reversed to change the positions of the first and second surfaces. Then the sheet is again conveyed to the loop forming roller. Similarly to the case of forming an image on the first surface, sheet skew is corrected.

Depending on whether or not an image is formed on the surface (opposite surface) of the sheet in contact with the drive roller 23*a*, namely, depending on the presence or absence of a toner image on the first surface, the friction coefficient on this opposite surface varies. Friction coefficient is smaller when there is a toner image than the case when there is no toner image.

Accordingly, after the rotation of the registration roller 23 has started, the sheet is conveyed downstream with the loop kept formed. If independently of presence or absence of a toner image on the opposite surface, the sheet is released from the nipping of the loop forming roller 22D after the lapse of a constant period of time, the amount of conveyance before the sheet is released from the nipping will be greater when there is no toner image on the opposite surface than when there is a toner image. The broken line of FIG. 6 indicates the position of the leading edge when there is no toner image on the opposite surface. The solid line denotes the position of the leading edge when there is a toner image on the opposite surface. As described above, depending on the presence or absence of a toner image, there is a difference d22 in the distance from the nip center of the registration roller 23 to the leading edge of the sheet.

Thus, when there is no toner image, the size of the fan-shaped portion is increased. To put it another way, there is an increase in the influence of the uneven loop.

To avoid this, if a step is taken to reduce the time before the sheet is released from the nipping of the loop forming roller 22D, the amount of conveyance will be insufficient when there is a toner image on the sheet, and nipping at the registration roller 23 will be insufficient. Thus, failure of secure conveyance may be caused by nipping failure.

In view of the problems described above, it is an object of the present invention to provide an image forming apparatus by which, in the step of conveying a sheet after skew thereof has been corrected by hitting the leading edge of the sheet against the registration roller and forming a loop, stable conveyance is ensured by preventing conveyance failure from occurring due to influence of the difference in the shape across the width of the loop formed at the time of skew correction.

SUMMARY

To achieve at least one of the above mentioned objects, an image forming apparatus reflecting one aspect of the present invention includes the following.

An image forming apparatus including:

a registration roller having a pair of rollers for correcting a skew of a sheet and conveying the sheet;

a loop forming roller arranged upstream of the registration roller in a sheet conveyance direction to hit a leading edge of the sheet against the registration roller and to form a loop of the sheet; and a control section for controlling rotation of the registration roller and rotation of the loop forming roller and for controlling nipping and releasing of a nip of the loop forming roller, wherein the control section controls to rotate the registration roller and the loop forming roller to conduct conveyance of the sheet with a loop formed thereon, downstream in the sheet conveyance direction, after forming the loop on the sheet by hitting the leading edge of the sheet against the registration roller, and controls the loop forming roller to release the sheet from nipping of the loop forming roller during the conveyance, and further controls to adjust a total number of rotations of the registration roller from a start of the conveyance of the sheet by the rotation of the registration roller and the rotation of the loop forming roller until the loop forming roller releases the sheet from the nipping, to a prescribed total number of rotations having been set according to a type of the sheet.

DETAILED DESCRIPTION OF THE PREFERRED EMBODIMENT

The following describes the embodiments of the present invention with reference to the drawings. However the present invention is not limited thereto.

Figure 1:
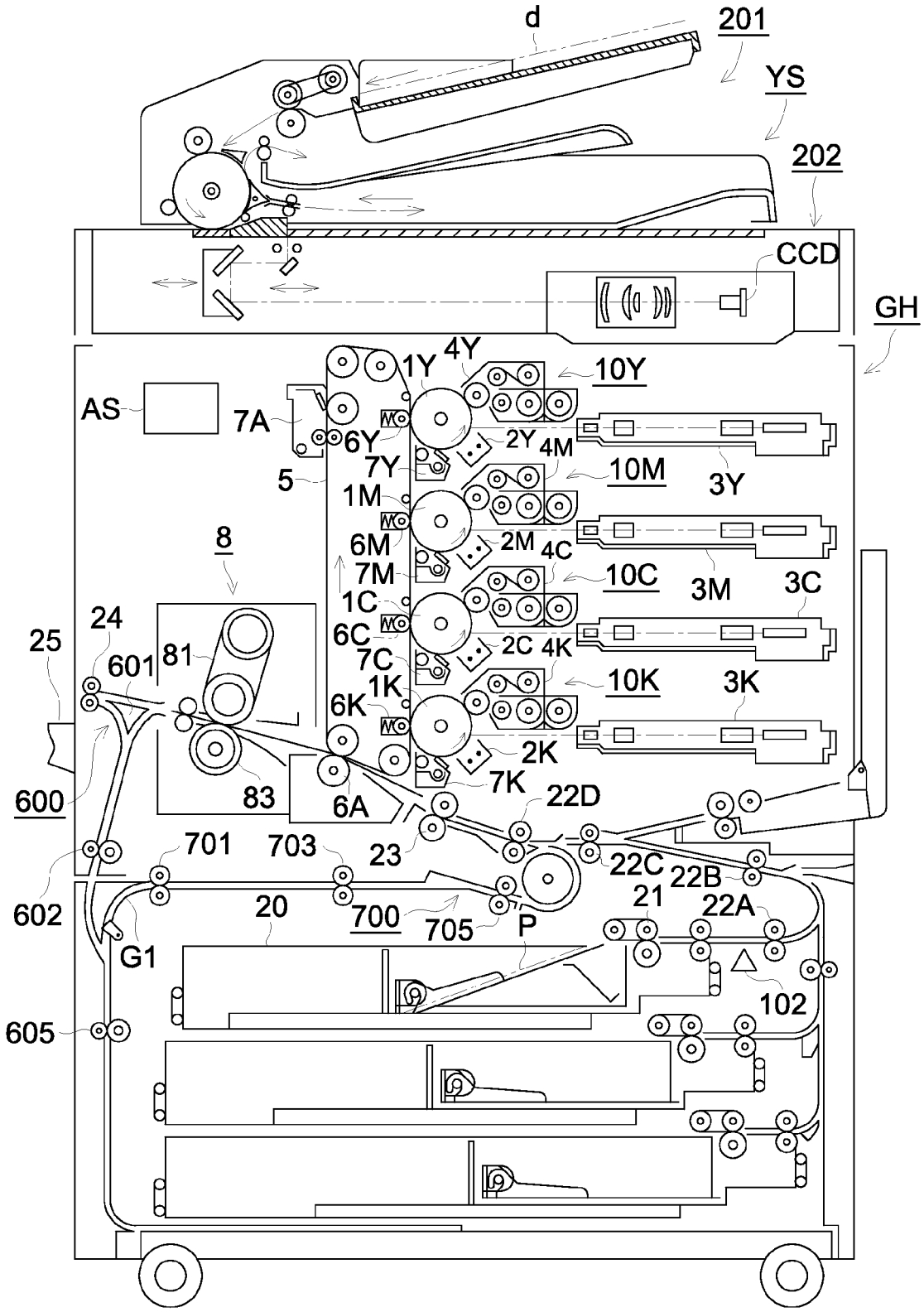
FIG. 1 is a drawing showing an example of the image forming apparatus related to the present invention.
Figure 2A:
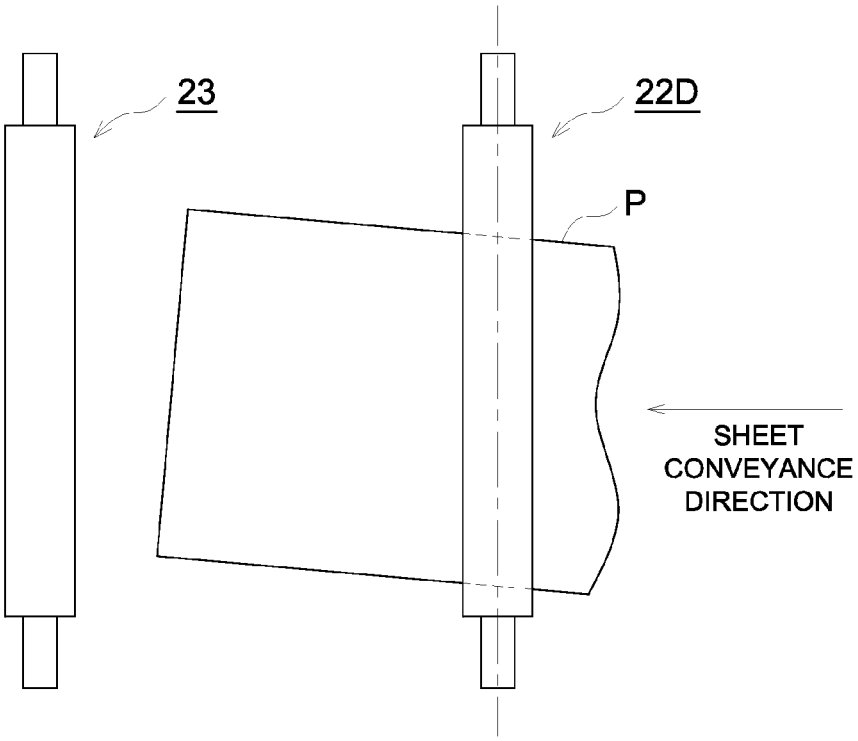
FIGS. 2*a* and 2*b* are schematic diagrams illustrating the sheet skew and skew correction.
Figure 2B:
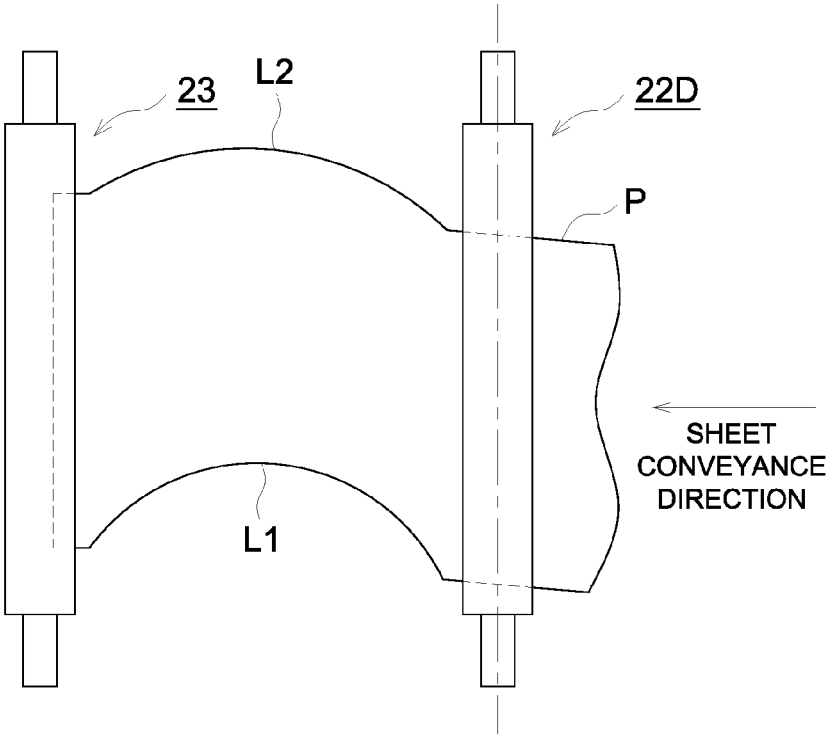

In the first place, an example of the image forming apparatus related to the present invention will be described with reference to the structural diagram of FIG. 1.

This image forming apparatus includes an image forming apparatus main body GH and an image reading device YS. The image forming apparatus main body GH is called the tandem color image forming apparatus, and includes a plurality of image forming sections 10Y, 10M, 10C and 10K, belt-shaped intermediate transfer belt 5, sheet feed and conveying unit and fixing device 8, reverse sheet ejection section 600 and ADU (Auto Duplex Unit) 700 for conducting reverse conveyance, and others.

Further, the image forming apparatus includes a control section AS for controlling each section.

The top of the image forming apparatus main body GH is provided with an image reading device YS including an automatic document feed device 201 and scanning exposure device 202. The document "d" placed on the document platen of the automatic document feed device 201 is conveyed by the conveying unit. An image on a surface or images on both surfaces of the document are subjected to scanning and exposure by the optical system of the scanning exposure device 202, and is read into the line image sensor CCD.

The signal formed by photoelectric conversion through the line image sensor CCD is subjected to analog processing, analog-to-digital conversion, shading correction and image compression in the image processing section, and is sent to the exposure units 3Y, 3M, 3C and 3K.

The image forming sections 10Y for forming a yellow (Y) image has a charging unit 2Y, exposure unit 3Y, development unit 4Y and cleaning unit 7Y arranged around the photoreceptor drum 1Y. The image forming sections 10M for forming a magenta (M) image has a charging unit 2M, exposure unit 3M, development unit 4M and cleaning unit 7M arranged around the photoreceptor drum 1M. The image forming sections 10C for forming a cyan (C) image has a charging unit 2C, exposure unit 3C, development unit 4C and cleaning unit 7C arranged around the photoreceptor drum 1C. The image forming sections 10K for forming a black (K) image has a charging unit 2K, exposure unit 3K, development unit 4K and cleaning unit 7K arranged around the photoreceptor drum 1K. Latent image forming units are formed by a charging unit 2Y and exposure unit 3Y, a charging unit 2M and exposure unit 3M, a charging unit 2C and exposure device 3C, and a charging unit 2K and exposure device 3K The development units 4Y, 4M, 4C and 4K include the two-component developer made of yellow (Y), magenta (M), cyan (C) and black (K) toners having a small particle diameter, and carriers. The toner is made of pigment or dye serving as a coloring reagent, a wax helping separation of toner from the fixing member after fixing, and a binder resin for holding these together.

The intermediate transfer belt 5 is wound around plural rollers and is supported rotatably.

The fixing device 8 allows the toner image of a sheet P to be heated and pressed by a nip portion formed between the heated fixing belt 81 which is a fixing member and pressure roller 83 which is a pressing member, whereby the toner image is fixed.

Thus, images of different colors formed by the image forming sections 10Y, 10M, 10C and 10K are sequentially transferred onto the rotating intermediate transfer belt 5 by the transfer units 6Y, 6M, 6C and 6K as a primary transfer, and a composite color toner image is created.

The sheet P stored in the sheet feed cassette 20 is fed by the sheet feed unit 21, and is conveyed to the transfer unit 6A through the sheet feed rollers 22A, 22B and 22C and loop forming roller 22D, registration roller 23 and others. Then the color image is transferred onto the sheet P as a secondary transfer.

At the loop forming roller 22D and registration roller 23, correction of skew and bias of the sheet P is conducted. Details of the correction of skew and bias will be described later.

The sheet P with the color image transferred thereon is heated and pressed by the fixing device 8, and the color toner image on the sheet P is fixed. After that, the sheet is sandwiched and conveyed by the sheet ejection roller 24 and is placed on the sheet ejection tray 25 provided outside the apparatus.

The sheet P can be reversed to change the positions of the front and rear surfaces to be ejected by switching the position of the passage switching member 601 of the reversing sheet ejection section 600.

For example, in the step of reversing and ejecting the sheet P, the position of the passage switching member 601 is switched so that the sheet P is guided downward along the right side of the passage switching member 601, and the sheet P is conveyed toward the roller pair 602. After the trailing end of the sheet P has been sandwiched between the roller pair 602, the roller pair 602 is rotated in the reverse direction so that the sheet P is raised. After that, the sheet P reaches the sheet ejection roller 24 through the left side of the passage switching member 601. The sheet P is then sandwiched by the sheet ejection roller 24 and conveyed to be placed on the sheet ejection tray 25 outside the apparatus.

In the duplex printing mode where the ADU 700 is employed, the sheet P with an image formed and fixed on one surface (the first surface) is led downward along the right side of the passage switching member 601. With the trailing edge of the sheet P sandwiched by the roller pair 605, conveyance is suspended.

This is followed by the step of reverse rotation of the roller pair 605. The sheet P is raised along the guide plate G1 and is led to the ADU 700 provided with plural roller pairs 701, 703 and 705, wherein the sheet P is reversed.

In the meantime, after a color image has been transferred onto the sheet P by the transfer device 6A, a cleaning device 7A is used to remove the toner remaining on the intermediate transfer belt 5 from which the sheet P has been removed by curvature.

The image forming apparatus for forming a color image has been described. The present invention is also applicable to an image forming apparatus for forming a monochromatic image. Further, use of an intermediate transfer belt is optional.

The fixing device 8 can use a thermal roller fixing method where a roller equipped with a heating device is used as a fixing member.

The following describes how the sheet P is conveyed by the registration roller 23 and loop forming roller 22D. The drive of these rollers and contact/separation of the nip are controlled by the control section AS.

Figure 7:
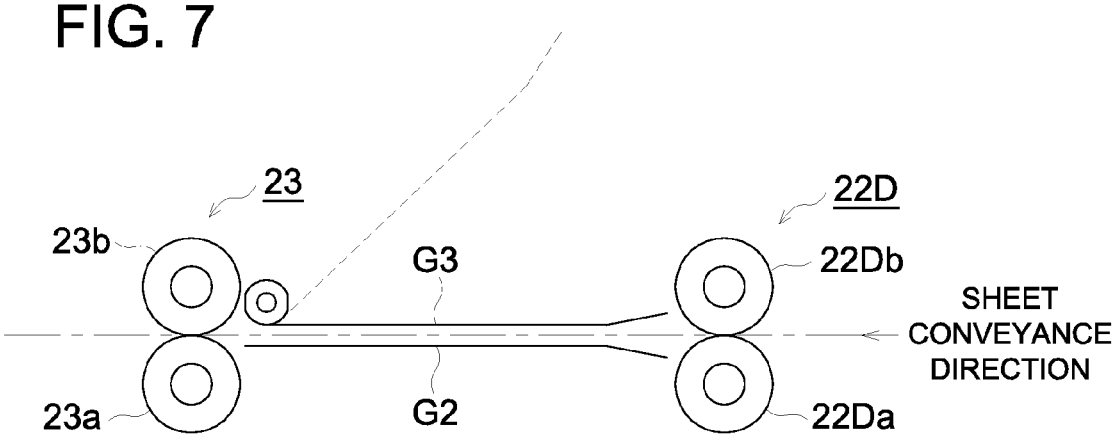
FIG. 7 is a lateral cross sectional view showing the major components located in the vicinity of the registration roller and loop forming roller.

FIG. 7 is a lateral cross sectional view showing the major components located in the vicinity of the registration roller 23 and loop forming roller 22D.

The registration roller 23 includes a drive roller 23*a* and a driven roller 23*b*, while the loop forming roller 22D includes a drive roller 22Da and driven roller 22Db. A lower guide plate G2 and an upper guide plate G3 are also arranged. The upper guide plate G3 is supported swingably toward the upper side (indicated by broken line) so that a loop of the sheet P can be formed on the upper side. The upper guide plate G3 can be omitted if the guide of the leading edge of the sheet is not required because of the center distance between the registration roller 23 and loop forming roller 22D or because of toughness of the sheet P to be used. Further, instead of the upper guide plate G3 being swingably supported, it is possible to increase the clearance between the lower guide plate G2 and the upper guide plate G3 at a prescribed position, by giving consideration to the formation of a loop of the sheet P.

There is no particular restriction to the material of the aforementioned rollers. For example, EPDM-made rubber rollers are preferably employed for the drive roller 23 a and drive roller 22Da, while stainless steel rollers are preferably used for the driven roller 23*b* and driven roller 22Db.

FIGS. 8*a*-8*d* are diagrams showing the process of conveying sheets P by the registration roller 23 and loop forming roller 22D.

As described above, the sheet P accommodated in the sheet feed cassette 20 is fed by the sheet feed device 21, and is conveyed to the loop forming roller 22D through the sheet feed rollers 22A, 22B and 22C.

Figure 8A:
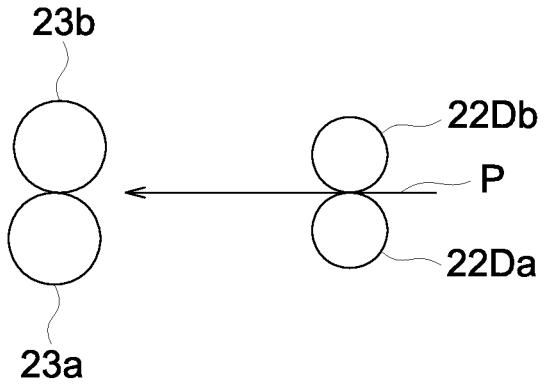
FIGS. 8*a*-8*d* are diagrams showing the process of conveying a sheet by the registration roller and loop forming roller.

The loop forming roller 22D conveys the sheet P to the registration roller 23 being suspended (FIG. 8*a*).

Figure 8B:
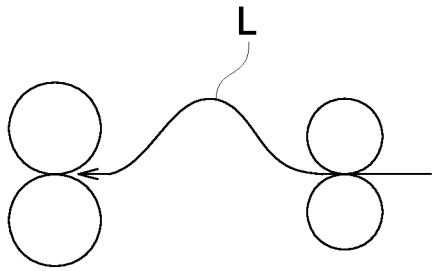

After having hit the leading edge of the sheet P against the registration roller 23, the loop forming roller 22D is rotated for a certain period of time, and is suspended after forming a loop L (FIG. 8*b*). This allows the entire side of the leading edge of the sheet to hit against the registration roller, whereby skew of the sheet P is corrected.

Figure 8C:
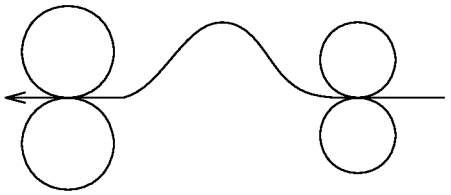

After skew of this sheet P has been corrected, the registration roller 23 starts rotation synchronously with formation of an image on the photoreceptor drum, and the sheet P is fed again. In this step of sheet re-feeding the registration roller 23 and loop forming roller 22D are also rotated, and the sheet P is conveyed while a loop is formed thereon (FIG. 8*c*).

Figure 8D:
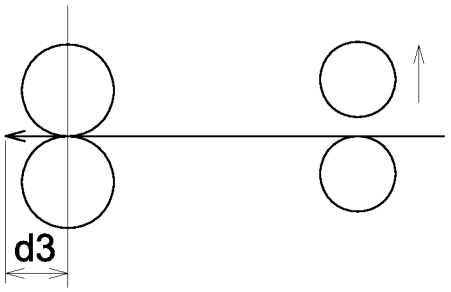

After sheet re-feeding of the sheet P has started, the drive roller 22Da and driven roller 22Db of the loop forming roller 22D are separated at a prescribed time and the sheet is released from the nipping (i.e., nipping is turned oft). This step removes the loop L of the sheet P (FIG. 8*d*). What is meant by "a prescribed time" is not restricted to time and it can be the total number of rotations of the registration roller 23 subsequent to the start of sheet re-feeding, for example.

Nipping condition is also called "nip on" state, while the cancellation condition of the nipping is also referred to as "nip off" state.

Figure 9:
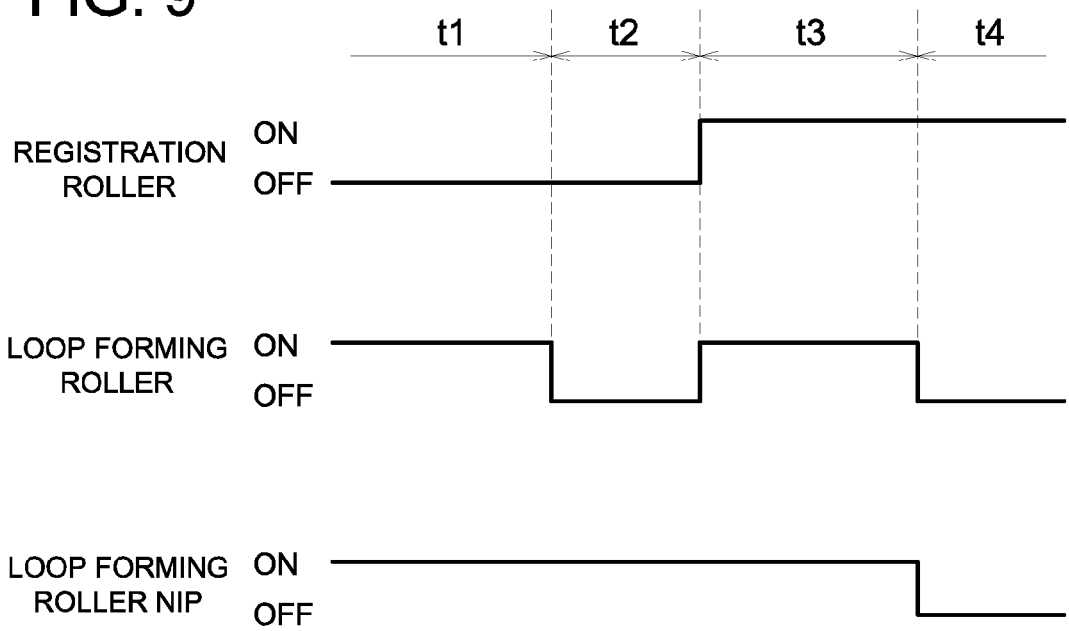
FIG. 9 is a timing chart showing the process of conveying sheets given in FIGS. 8*a*-8*d* .

FIG. 9 is a timing chart showing the process of conveying sheets given in FIGS. 8*a* through 8*d*. In FIG. 9, the time "t1" corresponds to the time period before the loop forming roller 22D is stopped, as shown in FIGS. 8*a* and 8*b*, and the time "t2" corresponds to the time period where the loop forming roller 22D in FIG. 8*b* is suspended. The time "t3" corresponds to FIG. 8*c*, and the time "t4" corresponds to FIG. 8*d*. The time "t3" of the chart indicates prescribed time duration from the start of sheet re-feeding of the sheet P, tilt the cancellation of the nipping in the loop forming roller 22D. Thus, as described above, what is meant by "a prescribed time" is not restricted to time, it can be the total number of rotations of the registration roller 23 subsequent to the start of sheet re-feeding, for example.

Figure 3:
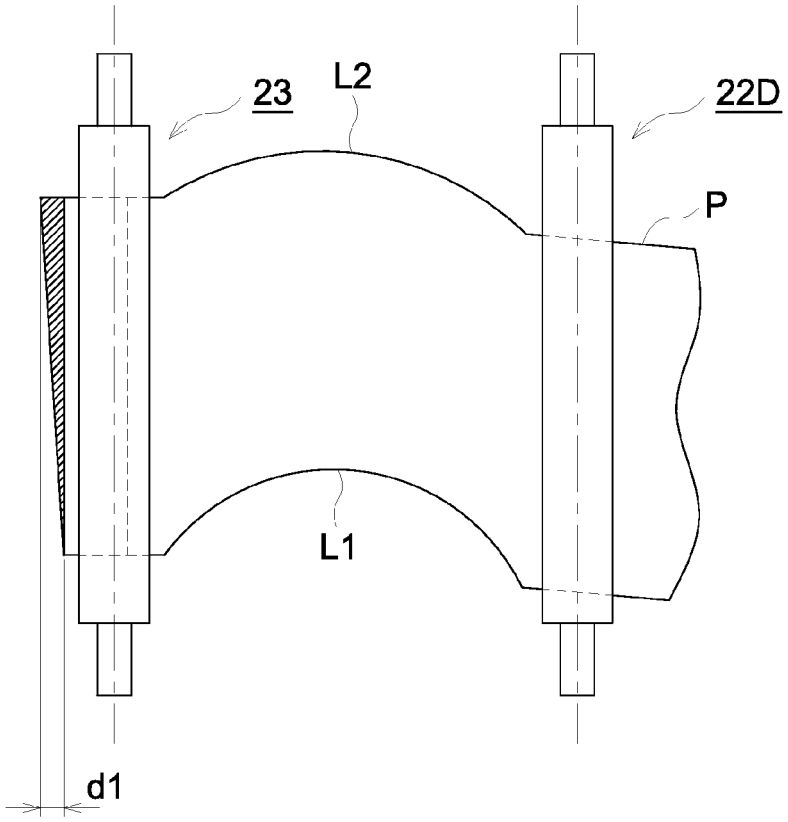
FIG. 3 is a schematic diagram illustrating that sheet is conveyed with the leading edge keeping a fan-shape form.
Figure 4:
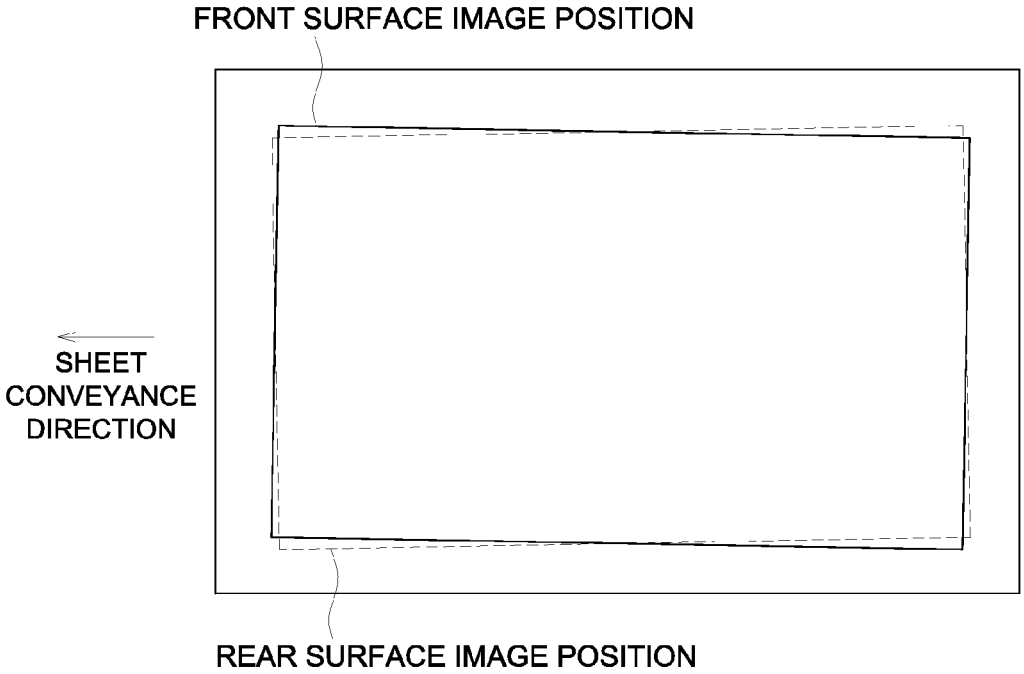
FIG. 4 is a drawing showing the position of an image when a fan shape has been produced on both surfaces in the duplex printing mode.

As described above, to prevent generation of a fan shape of FIG. 3 and to minimize image misalignment, it is preferred to cancel the nipping of the loop forming roller 22D as quickly as possible and to convey the sheet P by the registration roller 23 alone, thereby avoiding any influence of the uneven loop. To put it another way, it is preferred to shorten t3 as much as possible.

(Embodiment 1)

To shorten t3 for avoidance of any influence of the uneven loop and to ensure nipping of the sheet P by the registration roller 23 for stabilization of conveyance, it is preferred to cancel the nipping of the loop forming roller 22D at a constant distance after the leading edge of the sheet P has passed through the nip section N of the registration roller 23, independently of paper thickness as a sheet type. To put it another way, the distance d3 between the nip section N and the leading edge of the sheet P in FIG. 8*d* is preferably kept at an approximately constant value.

Figure 5:
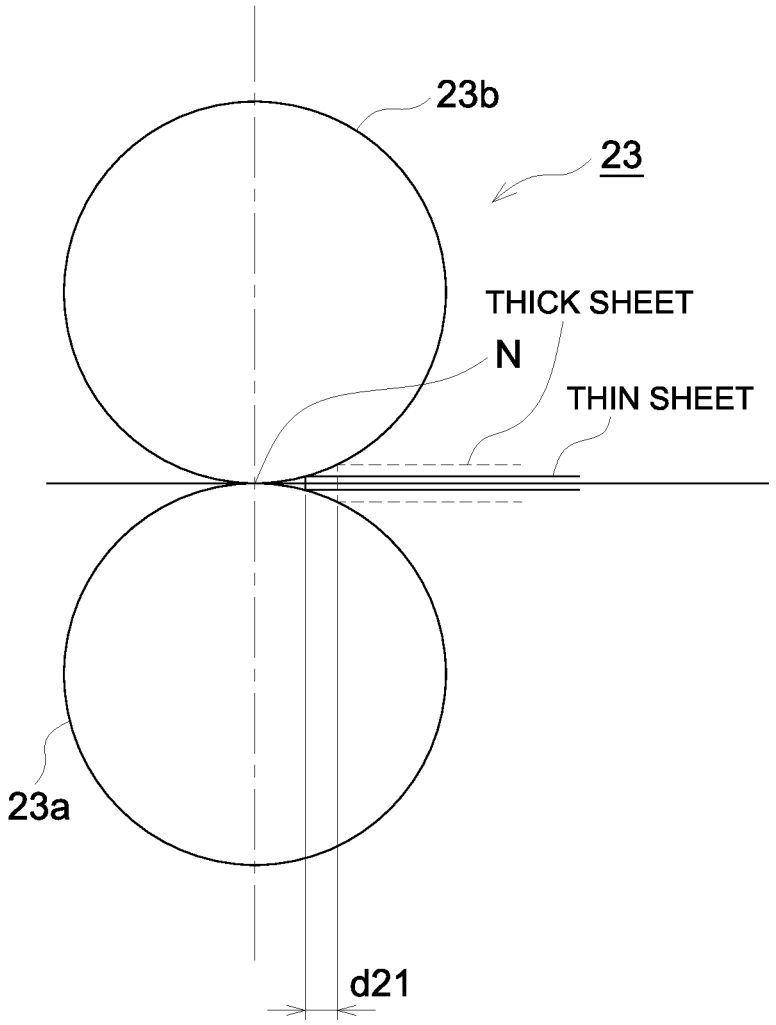
FIG. 5 is a diagram illustrating that the leading edges of the thin sheet and thick sheet have been hit against on the registration roller.
Figure 6:
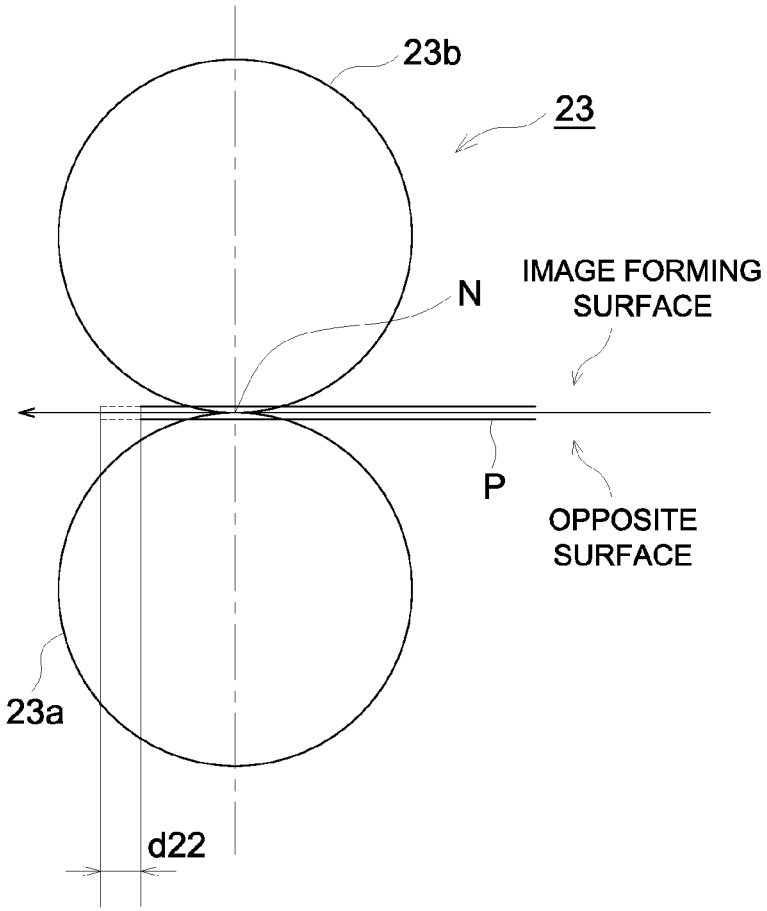
FIG. 6 is a diagram showing the positional relationship between the drive roller and the driven roller of the registration roller.

However, as shown in the aforementioned FIG. 5, when the leading edge of the sheet has been hit against the registration roller 23, the leading edge of the thin sheet is placed closer to the nip section N formed by the drive roller 23*a* and driven roller 23*b*, than that of the thick sheet. This produces a difference of distance d21.

Thus, the following problem occurs if the nipping of the loop forming roller 22D is cancelled at a constant time subsequent to the start of sheet re-feeding independently of the thickness of paper as in the conventional art. That is, the distance d3 between the nip section N and the leading edge of the sheet P when the nipping is cancelled is greater in the case of a thin sheet than in the case of a thick sheet. This problem makes it difficult to control the distance d3 at a constant value.

One possible way of controlling the distance d3 at a constant value is to install a sensor to detect the leading edge of the sheet P, at a position immediately after the nip. Immediately after the nip, however, rollers and shafts are already installed and a limited space raises a problem difficult to solve.

<Control Example 1>

In the present embodiment of the invention, the control section AS provides control in such a way that the total number of rotations of the registration roller 23 from the start of rotation of the registration roller 23 until the cancellation of the nipping of the loop forming roller 22D is kept at a prescribed total number of rotations set in response to the thickness of the sheet P.

To put it another way, control is provided in such a way as to cancel the nipping of the loop forming roller 22D, when the total number of rotations of the registration roller 23 has reached a prescribed total number of rotations set in conformance to the thickness of the sheet P, subsequent to the start of rotation of the registration roller 23 (after start of sheet re-feeding). This means that the amount of conveyance from the start of sheet re-feeding until the cancellation of the nipping of the loop forming roller 22D is equalized to the value in conformance to the thickness of paper. Immediately after the nipping has been cancelled, the rotation of the loop forming roller 22D is suspended.

The term "total number of rotations" indicates the total number of rotations of the registration roller 23, subsequent to the start of rotation of the registration roller 23 (subsequent to the start of sheet re-feeding).

The aforementioned total number of rotations can be detected by a rotation detecting mechanism (not illustrated) such as a rotary encoder for detecting the total number of rotations, which is connected to the registration roller 23 or a drive source as exemplified by a drive motor. By detecting the total number of rotations of the registration roller 23 or drive motor as described above, it is possible to remove influence of the fluctuation in the rotational speed of the drive motor or the fluctuation in the rotational speed at the time of initiating the rotation at the start-up.

A stepping motor can be used to drive the registration roller 23, and the control of the total number of rotations can be done by pulse control.

As shown in FIG. 5, when the leading edge of the sheet has been hit against the registration roller 23, the leading edge of the thin sheet is placed closer to the nip section N formed by the drive roller 23*a* and driven roller 23*b*, than that of the thick sheet. This produces a difference of distance d21. Accordingly, to keep the distance d3 at approximately a constant level independently of paper thickness, a prescribed total number of rotations must be set at a higher value for thick sheets than for thin sheets.

The aforementioned prescribed total number of rotations is set in advance in conformance to the paper thickness based on the design specifications or experiment It should be noted that the prescribed total number of rotations can be set for each of paper thicknesses. Alternatively, paper thicknesses is classified according to prescribed ranges to set up the groups of paper thicknesses, and the prescribed total number of rotations can be set for each of these groups.

The paper thickness and prescribed total number of rotations set in conformance to the paper thickness are formulated into a data table, for example, and are stored into the storage section (not illustrated) of the image forming apparatus main body GH in advance.

At the time of printing, an operator selects the type of paper (paper thickness) on an operation panel (not illustrated) of the image forming apparatus main body GH, or selects a sheet feed cassette 20. Then the data on prescribed total number of rotations in conformance to paper thickness is selected from the aforementioned data table. The control section provides control based on the data.

When the nipping of the loop forming roller 22D has been cancelled, the loop disappears and the sheet P is conveyed after skew has been corrected. In the process of sheet conveyance, bias of the sheet P across the width is corrected.

Figure 10:
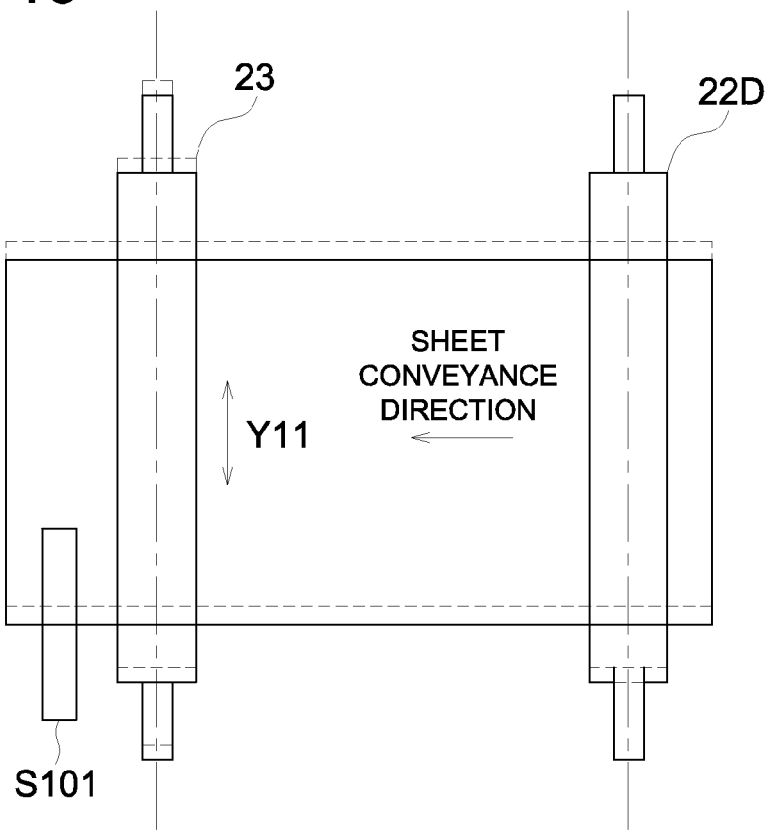
FIG. 10 is a diagram showing a step of correcting the bias across the sheet width.

FIG. 10 is a diagram showing a step of correcting the bias. An end face detecting sensor S101 for detecting the position of the end face of the sheet P across the width is arranged upstream of the registration roller 23. Further, the registration roller 23 is supported movably across the width of the sheet P, and is moved in the direction of the arrow Y11 by a traveling mechanism (not illustrated).

When bias of the sheet P has been detected by the end face detecting sensor S101, the traveling mechanism moves the registration roller 23 in the direction of correcting the bias, whereby bias is corrected.

As shown in FIG. 10, when the end face detecting sensor S101 has found out that the sheet P is biased toward the near side (downward in the drawing) (portion marked by a solid line), the traveling mechanism moves the registration roller 23 toward the far side (upward in the drawing) so that the sheet P is moved (portion marked by a broken line), whereby bias is corrected.

The aforementioned procedure allows the distance d3 to be kept at the minimum distance which is approximately constant, independently of paper thickness. This prevents a fan shape from occurring due to loop unevenness (an uneven loop). This also ensures stable conveyance subsequent to registration, whereby image misalignment is suppressed.

In the aforementioned description, the control for keeping the distance d3 at an approximately constant level independently of paper thickness is achieved by detecting the total number of rotations of the registration roller 23 or drive motor (named Control Example 1). This can also be achieved by controlling the rotation time or rotational speed of the registration roller 23. Examples are given below.

<Control Example 2>

In the Control Example 2, the rotational speed of the registration roller 23 is kept constant independently of paper thickness, and the rotation time is controlled in conformance to paper thickness. Accordingly, a longer rotation time is set for a thick sheet than for a thin sheet. In the case of Control Example 2, if a motor of constant rotational speed is used to drive the registration roller 23, only the rotation time can be placed under control. This makes it possible to omit the mechanism for detecting the total number of rotations of the registration roller 23, and to simplify the structure of the mechanism.

The rotation time in the Control Example 2 is set in advance according to the paper thickness based on the design specifications or experiment. It is preferably set with consideration given to fluctuations of the rotational speed at the time of initiating the rotation at the start-up of the drive motor. The rotation time can be set for each of the paper thicknesses. Alternatively, paper thicknesses is classified according to prescribed ranges to set up the groups of paper thicknesses, and the rotation time can be set for each of these groups.

<Control Example 3>

In the Control Example 3, the rotation time of the registration roller 23 is set at a constant value, independently of paper thickness, and the rotational speed is controlled in conformance to paper thickness. Accordingly, the rotational speed is set at a higher value for a thick sheet than for a thin sheet. In the Control Example 3, the registration roller 23 is driven preferably by a drive motor whose rotational speed can be easily changed. Further, this makes it possible to omit the mechanism for detecting the total number of rotations of the registration roller 23, and to simplify the structure of the mechanism.

The rotational speed in the Control Example 3 is preset in conformance to paper thickness based on the design specifications or experiment. The rotational speed is preferably set with consideration given to fluctuations of the rotational speed at the time of initiating the rotation at the drive motor start-up. The rotation speed can be set for each of the paper thicknesses. Alternatively, paper thicknesses is classified according to prescribed ranges to set up the groups of paper thicknesses, and the rotational speed can be set for each of these groups. In the aforementioned Control Examples 2 and 3, in conformance to paper thickness, one of the rotational speed and rotation time is assumed to be constant, and the other is controlled. Without the present invention being restricted thereto, both the rotational speed and rotation time can be controlled by the control section according to paper thickness.

(Embodiment 2)

To shorten t3 for avoidance of any influence of the uneven loop and to ensure nipping of the sheet P by the registration roller 23 for stabilisation of conveyance, it is preferred to cancel the nipping of the loop forming roller 22D at a constant distance after the leading edge of the sheet P has passed through the nip section N of the registration roller 23, independently of the presence or absence of a toner image on the opposite surface as a sheet type. To put it another way, the distance d3 between the nip section N and the leading edge of the sheet P in FIG. 8*d* is preferably kept at an approximately constant value.

However, as described above, the friction coefficient on the opposite surface of the sheet P varies depending on presence or absence of a toner image on the opposite surface. The friction coefficient is smaller when there is a toner image than when there is no toner image. Therefore, the slippage is greater when there is a toner image and the conveyance amount per one rotation of the registration roller 23 is smaller.

Thus, the following problem occurs if the nipping of the loop forming roller 22D is cancelled at a constant time subsequent to the start of sheet re-feeding independently of the presence or absence of a toner image on the opposite surface as in the conventional art. That is, the distance d3 between the nip section N and the leading edge of the sheet P when the nipping is cancelled is greater in the case of absence of a toner image than in the case of presence of a toner image. This problem makes it difficult to control the distance d3 at a constant value.

One possible way of controlling the distance d3 at a constant value is to install a sensor to detect the leading edge of the sheet P, at a position immediately after the nip. Immediately after the nip, however, rollers and shafts are already installed and a limited space raises a problem difficult to solve.

<Control Example 4>

In the present embodiment of the invention, the control section AS provides control in such a way that the total number of rotations of the registration roller 23 from the start of rotation of the registration roller 23 until the cancellation of the nipping of the loop forming roller 22D is kept at a prescribed total number of rotations set in response to presence or absence of a toner image on the opposite surface of the sheet P.

To put it another way, control is provided in such a way as to cancel the nipping of the loop forming roller 22D, when the total number of rotations of the registration roller 23 has reached a prescribed total number of rotations set in conformance to the presence or absence of a toner image, subsequent to the start of rotation of the registration roller 23 (after start of sheet re-feeding).

This means that the amount of conveyance from the start of sheet re-feeding until the cancellation of the nipping of the loop forming roller 22D is equalized to the approximately constant value independently of presence of absence of a toner image on the opposite surface of the sheet P. Immediately after the nipping has been cancelled, the rotation of the loop forming roller 22D is suspended.

The aforementioned total number of rotations can be detected by a rotation detecting mechanism (not illustrated) such as a rotary encoder for detecting rotations, which is connected to the registration roller 23 or a drive source as exemplified by a drive motor (not illustrated). By detecting the total number of rotations of the registration roller 23 or drive motor as described above, it is possible to remove influence of the fluctuation in the rotational speed of the drive motor or the fluctuation in the rotational speed at the time of initiating the rotation at the start-up.

A stepping motor can be used to drive the registration roller 23, and the control of the total number of rotations can be done by pulse control.

As described above, the friction coefficient on the opposite surface varies depending on presence or absence of a toner image on the opposite surface of the sheet P. The friction coefficient is smaller when there is a toner image than when there is no toner image. Therefore, the slippage is greater when there is a toner image and the conveyance amount per one rotation of the registration roller 23 is smaller.

Accordingly, to keep the distance d3 at approximately a constant level independently of presence or absence of a toner image on the opposite surface of the sheet P, a prescribed total number of rotations must be set at a higher value when there is a toner image than when there is no toner image on the opposite surface.

The aforementioned prescribed total number of rotations is set in advance in conformance to presence or absence of a toner image on the opposite surface based on the design specifications or experiment The presence or absence of a toner image and prescribed total number of rotations set in conformance to this are formulated into a data table, for example, and are stored into the storage section (not illustrated) of the image forming apparatus main body GH in advance.

At the time of printing, based on information on whether an operator has selected the duplex printing or on whether a toner image has been formed on the first surface due to the duplex printing, the data on prescribed total number of rotations in conformance to whether a toner image has been formed on the opposite surface of the sheet P is selected from the aforementioned data table. The control section provides control based on the data.

When the nipping of the loop forming roller 22D has been cancelled, the loop disappears and the sheet P is conveyed after skew has been corrected. In the process of sheet conveyance, bias of the sheet P across the width is corrected.

FIG. 10 is a diagram showing a step of correcting the bias. An end face detecting sensor S101 for detecting the position of the end face of the sheet P across the width is arranged upstream of the registration roller 23. Further, the registration roller 23 is supported movably across the width of the sheet P, and is moved in the direction of the arrow Y11 by a traveling mechanism (not illustrated).

When bias of the sheet P has been detected by the end face detecting sensor S101, the traveling mechanism moves the registration roller 23 in the direction of correcting the bias, whereby bias is corrected.

As shown in FIG. 10, when the end face detecting sensor S101 has found out that the sheet P is biased toward the near side (downward in the drawing) (portion marked by a solid line), the traveling mechanism moves the registration roller 23 toward the far side (upward in the drawing) so that the sheet P is moved (portion marked by a broken line), whereby bias is corrected.

The aforementioned procedure allows the distance d3 to be kept at the minimum distance which is approximately constant, independently of whether a toner image has been formed on the surface on the sheet P, which comes in contact with the drive roller 23*a* of the registration roller 23. This prevents a fan shape from occurring due to loop unevenness (an uneven loop). This also ensures stable conveyance subsequent to registration, whereby image misalignment is suppressed.

In the aforementioned description, the control for keeping the distance d3 at an approximately constant level is achieved by detecting the number of rotations of the registration roller 23 or drive motor and by controlling the total number of rotations according to the presence or absence of a toner image (named Control Example 4). This can also be achieved by controlling the rotation time or rotational speed of the registration roller 23. Examples are given below.

<Control Example 5>

In the Control Example 5, the rotational speed of the registration roller 23 is kept constant independently of the presence or absence of a toner image on the opposite surface of the sheet P, and the rotation time is controlled in conformance to the presence or absence of a toner image, thereby controlling the total number of rotations of the registration roller 23. Accordingly, a longer rotation time is set when there is a toner image than when there is no toner image. In the case of Control Example 5, if a motor of constant rotational speed is used to drive the registration roller 23, only the rotation time can be placed under control. This makes it possible to omit the mechanism for detecting the number of rotations of the registration roller 23, and to simplify the structure of the mechanism.

The rotation time in the Control Example 5 is set in advance according to the presence or absence of a toner image based on the design specifications or experiment It is preferably set with consideration given to fluctuations of the rotational speed at the time of initiating the rotation at the start-up of the drive motor.

<Control Example 6>

In the Control Example 6, the rotation time of the registration roller 23 is set at a constant value, independently of presence or absence of a toner image on the opposite surface of the sheet P, and the rotational speed is controlled in conformance to the presence or absence of a toner image, thereby controlling the total number of rotations of the registration roller 23. Accordingly, the rotational speed is set at a higher value when there is a toner image than when there is no toner image. In the Control Example 6, the registration roller 23 is driven preferably by a drive motor whose rotational speed can be easily changed. Further, this makes it possible to omit the mechanism for detecting the total number of rotations of the registration roller 23, and to simplify the structure of the mechanism.

The rotational speed in the Control Example 6 is preset in conformance to whether a toner image has been formed on the opposite surface of the sheet P based on the design specifications or experiment. The rotational speed is preferably set with consideration given to fluctuations of the rotational speed at the time of initiating the rotation at the drive motor start-up.

In the aforementioned Control Examples 5 and 6, in conformance whether a toner image has been formed on the opposite surface of the sheet P, one of the rotational speed and rotation time is assumed to be constant, and the other is controlled. Without the present invention being restricted thereto, both the rotational speed and rotation time can be controlled by the control section according to whether a toner image has been formed on the opposite surface of the sheet P.

The aforementioned arrangement prevents generation of a fan shape due to loop unevenness (an uneven loop), independently of the type of the sheet, and ensures stable conveyance subsequent to registration, whereby image misalignment can be suppressed.

What is claimed is:

1. An image forming apparatus comprising:

a registration roller having a pair of rollers that correct a skew of a sheet and convey the sheet;

a loop forming roller arranged upstream of the registration roller in a sheet conveyance direction to hit a leading edge of the sheet against the registration roller and to form a loop of the sheet between the registration roller and the loop forming roller; and a control section configured to control rotation of the registration roller and rotation of the loop forming roller and to control nipping and releasing of the sheet by the loop forming roller, the control section configured to perform the following operations:

rotating the loop forming roller to hit the leading edge of the sheet against the registration roller with the registration roller being stopped and convey the sheet for forming the loop of the sheet;

stopping the loop forming roller to stop the sheet having the loop thereon;

thereafter starting of rotation of the registration roller and the loop forming roller to convey the sheet in the sheet conveyance direction; and releasing the sheet from the nipping by the loop forming roller during the conveyance of the sheet by the registration roller, wherein the releasing of the sheet from the nipping by the loop forming roller occurs once a total number of rotations of the registration roller after the starting of the rotation of the registration roller and the loop forming roller reaches a prescribed total number of rotations;

wherein the prescribed total number of rotations is set based on a type of the sheet; and wherein the prescribed total number of rotations is set such that a distance between a tip of the sheet and a center of a nip portion of the registration roller when the loop forming roller releases the sheet is constant independently of the type of the sheet.

2. The image forming apparatus of claim 1, wherein the control section controls the total number of rotations of the registration roller by changing at least one of rotational speed and rotation time of the registration roller.

3. The image forming apparatus of claim 2, wherein the control section controls the total number of rotations of the registration roller by keeping the rotational speed constant independently of the type of the sheet and by changing the rotation time according to the type of the sheet.

4. The image forming apparatus of claim 2, wherein the control section controls the total number of rotations of the registration roller by keeping the rotation time constant independently of the type of the sheet and by changing the rotational speed according to the type of the sheet.

5. The image forming apparatus of claim 1, wherein the control section controls to correct a bias of the sheet by shifting the registration roller in a width direction of the sheet which is perpendicular to the sheet conveyance direction after releasing the sheet from the nipping of the loop forming roller.

6. The image forming apparatus of claim 1, wherein the type of the sheet depends on sheet thickness.

7. The image forming apparatus of claim 6, wherein the prescribed total number of rotations is set to be greater for a thicker sheet than a thinner sheet.

8. The image forming apparatus of claim 1, wherein the type of the sheet depends on whether a toner image has been formed on a first surface of the sheet.

9. The image forming apparatus of claim 8, wherein the prescribed total number of rotations is set to be greater when a toner image has been formed on the first surface than when a toner image has not been formed on the first surface.

* * * * *